US011114040B2

(12) United States Patent
Shan

(10) Patent No.: US 11,114,040 B2
(45) Date of Patent: Sep. 7, 2021

(54) PIXEL DRIVING METHOD

(71) Applicants: Chengdu BOE Optoelectronics Technology Co., Ltd., Sichuan (CN); BOE Technology Group Co., Ltd., Beijing (CN)

(72) Inventor: Dongxiao Shan, Beijing (CN)

(73) Assignees: CHENGDU BOE OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/943,220

(22) Filed: Jul. 30, 2020

(65) Prior Publication Data

US 2021/0065636 A1 Mar. 4, 2021

(30) Foreign Application Priority Data

Aug. 30, 2019 (CN) ..... 201910813219.6

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2310/0297* (2013.01)

(58) Field of Classification Search
CPC .. G09G 3/3291; G09G 3/3258; G09G 3/3266; G09G 2310/0248; G09G 2310/0251
See application file for complete search history.

(56) References Cited

U.S. PATENT DOCUMENTS

| | | | | |
|---|---|---|---|---|
| 9,747,843 | B2 * | 8/2017 | Na | G09G 3/3291 |
| 10,249,247 | B2 | 4/2019 | Wang et al. | |
| 10,395,613 | B2 * | 8/2019 | Chen | G09G 3/3648 |
| 2014/0307004 | A1 * | 10/2014 | Roh | G09G 3/3208 345/690 |

(Continued)

FOREIGN PATENT DOCUMENTS

| | | | |
|---|---|---|---|
| CN | 105118430 | A | 12/2015 |
| CN | 106292096 | A | 1/2017 |

(Continued)

OTHER PUBLICATIONS

Office Action dated Jul. 3, 2020, issued in counterpart CN Application No. 201910813219.6, with English translation (18 pages).

*Primary Examiner* — Sardis F Azongha
(74) *Attorney, Agent, or Firm* — Westerman, Hattori, Daniels & Adrian, LLP

(57) ABSTRACT

The present application discloses a pixel driving method, comprising: in a pre-charging phase, turning on a second driving branch to write a preset voltage into a second data line, and then turning off the second driving branch and turning on a first driving branch to write the preset voltage into a first data line; in a first data writing phase, keeping the first driving branch to be turned on to write a first data voltage into the first data line, and then turning off the first driving branch; and in a second data writing phase, turning on the second driving branch to write a second data voltage into the second data line.

12 Claims, 6 Drawing Sheets

(56) References Cited

U.S. PATENT DOCUMENTS

| | | | | |
|---|---|---|---|---|
| 2017/0061890 | A1 | 3/2017 | Zhou | |
| 2021/0043149 | A1* | 2/2021 | Yoo | G09G 3/3291 |

FOREIGN PATENT DOCUMENTS

| | | | |
|---|---|---|---|
| CN | 107146587 | A | 9/2017 |
| CN | 108428433 | A | 8/2018 |
| CN | 109801585 | A | 5/2019 |

* cited by examiner

PIXEL DRIVING METHOD

CROSS-REFERENCE TO RELATED APPLICATION(S)

This application claims priority to the Chinese Patent Application No. 201910813219.6, filed on Aug. 30, 2019, which is incorporated herein by reference in its entirety.

TECHNICAL FIELD

The present disclosure generally relates to the field of display technology, and more particularly, to a pixel driving method.

BACKGROUND

With the increasing resolution of Active-matrix Organic Light Emitting Diode (AMOLED) panels, a manufacturing process of modules of a source driving circuit is challenged. In order to reduce a number of data voltage output terminals of the source driving circuit, a multiplexing technology is introduced, that is, two or more columns of pixels are driven by the same multiplexer.

SUMMARY

The present disclosure provides a pixel driving method to reduce an alternating current load during pixel driving.

According to a first aspect, the present disclosure provides a pixel driving method applied to a display panel comprising pixels in N rows and 2M columns and 2M data lines respectively coupled to the 2M columns of pixels, the display panel further comprising M multiplexers each of which is coupled to two data lines of the 2M data lines and has a first driving branch coupled to a first one of the two data lines and a second driving branch coupled to a second one of the two data lines, the pixel driving method comprising: for each of the multiplexers, in a pre-charging phase, turning on the second driving branch to write a preset voltage into the second data line, and turning off the second driving branch and turning on the first driving branch after the preset voltage written into the second data line is stable to write the preset voltage into the first data line;

in a first data writing phase, keeping the first driving branch to be turned on to write a first data voltage into the first data line, and turning off the first driving branch after the first data voltage written into the first data line is stable; and in a second data writing phase, turning on the second driving branch to write a second data voltage into the second data line.

Further, the pixel driving method further comprises:

in the first data writing phase, turning on at least one row of pixels among the N rows of pixels after the first data voltage written into the first data line is stable, so that the first data voltage at the first data line is written into pixels coupled to the first data line among the at least one row of pixels, and the preset voltage at the second data line is written into pixels coupled to the second data line among the at least one row of pixels; and in the second data writing phase, keeping the at least one row of pixels to be turned on, keeping the first data voltage at the first data line to be unchanged, so that the second data voltage at the second data line is written into the pixels coupled to the second data line among the at least one row of pixels, and turning off the at least one row of pixels after the second data voltage written into the pixels coupled to the second data line among the at least one row of pixels is stable.

Further, the pixel driving method further comprises:

in the second data writing phase, keeping the second driving branch to be turned on after the second data voltage written into the pixels coupled to the second data line among the at least one row of pixels is stable, until a pre-charging phase for at least another row of pixels among the N rows of pixels arrives.

Further, the preset voltage is lower or higher than the first data voltage and the second data voltage.

Further, the first driving branch comprises a first switching element, the second driving branch comprises a second switching element, the first switching element is turned on or turned off according to a first switching signal, and the second switching element is turned on or turned off according to a second switching signal, wherein in the pre-charging phase, providing the first switching signal at a first level and the second switching signal at a second level, so that the first switching element is turned off and the second switching element is turned on, so as to write the preset voltage into the second data line, and providing the first switching signal at the second level and the second switching signal at the first level after the preset voltage written into the second data line is stable, so that the first switching element is turned on and the second switching element is turned off, so as to write the preset voltage into the first data line;

in the first data writing phase, providing the first switching signal at the second level and the second switching signal at the first level, and keeping the first switching element to be turned on and the second switching element to be turned off, so as to write the first data voltage into the first data line, and providing the first switching signal at the first level after the first data voltage written into the first data line is stable, so that the first switching element is turned off; and in the second data writing phase, providing the second switching signal at the second level, so that the second switching element is turned on, so as to write the second data voltage into the second data line.

Further, the first switching element and the second switching element are thin film transistors.

According to a second aspect, the present disclosure provides a pixel driving method applied to a display panel comprising pixels in N rows and 2M columns and 2M data lines respectively coupled to the 2M columns of pixels, the display panel further comprising M multiplexers each of which is coupled to two data lines of the 2M data lines and has a first driving branch coupled to a first one of the two data lines and a second driving branch coupled to a second one of the two data lines, the pixel driving method comprising: for each of the multiplexers, in a pre-charging phase, turning on the second driving branch to write a preset voltage into the second data line, and turning off the second driving branch after the preset voltage written into the second data line is stable;

in a first data writing phase, turning on the first driving branch to write a first data voltage into the first data line, and turning off the first driving branch after the first data voltage written into the first data line is stable; and in a second data writing phase, turning on the second driving branch to write a second data voltage into the second data line.

Further, the pixel driving method further comprises:

in the first data writing phase, turning on at least one row of pixels among the N rows of pixels after the first data voltage written into the first data line is stable, so that the first data voltage at the first data line is written into pixels coupled to the first data line among the at least one row of pixels, and the preset voltage at the second data line is written into pixels coupled to the second data line among the at least one row of pixels; and in the second data writing phase, keeping the at least one row of pixels to be turned on, and keeping the first data voltage at the first data line to be unchanged, so that the second data voltage at the second data line is written into the pixels coupled to the second data line among the at least one row of pixels, and turning off the at least one row of pixels after the second data voltage written into the pixels coupled to the second data line among the at least one row of pixels is stable.

Further, the pixel driving method further comprises:

in the second data writing phase, keeping the second driving branch to be turned on after the second data voltage written into the pixels coupled to the second data line among the at least one row of pixels is stable, until a pre-charging phase for at least another row of pixels among the N rows of pixels arrives.

Further, the preset voltage is lower or higher than the first data voltage and the second data voltage.

Further, the first driving branch comprises a first switching element, the second driving branch comprises a second switching element, the first switching element is turned on or turned off according to a first switching signal, and the second switching element is turned on or turned off according to a second switching signal, wherein in the pre-charging phase, providing the first switching signal at a first level and the second switching signal at a second level, so that the first switching element is turned off and the second switching element is turned on, so as to write the preset voltage into the second data line, and providing the second switching signal at the first level after the preset voltage written into the second data line is stable, so that the second switching element is turned off;

in the first data writing phase, providing the first switching signal at the second level, so that the first switching element is turned on, so as to write the first data voltage into the first data line, and providing the first switching signal at the first level after the first data voltage written into the first data line is stable, so that the first switching element is turned off; and in the second data writing phase, providing the second switching signal at the second level, so that the second switching element is turned on, so as to write the second data voltage into the second data line.

Further, the first switching element and the second switching element are thin film transistors.

BRIEF DESCRIPTION OF THE ACCOMPANYING DRAWINGS

By reading the detailed description of the non-limiting embodiments with reference to the following accompanying drawings, other features, objects and advantages of the present disclosure will become more apparent:

DETAILED DESCRIPTION

The present disclosure will be further described in detail below with reference to the accompanying drawings and embodiments. It may be understood that the specific embodiments described here are only used to explain the related disclosure, but not to limit the present disclosure. In addition, it should be illustrated that, for convenience of description, only the parts related to the present disclosure are shown in the accompanying drawings.

It should be illustrated that the embodiments in the present application and the features of the embodiments may be combined with each other without a conflict. Hereinafter, the present disclosure will be described in detail with reference to the accompanying drawings and in conjunction with embodiments.

Figure 1:
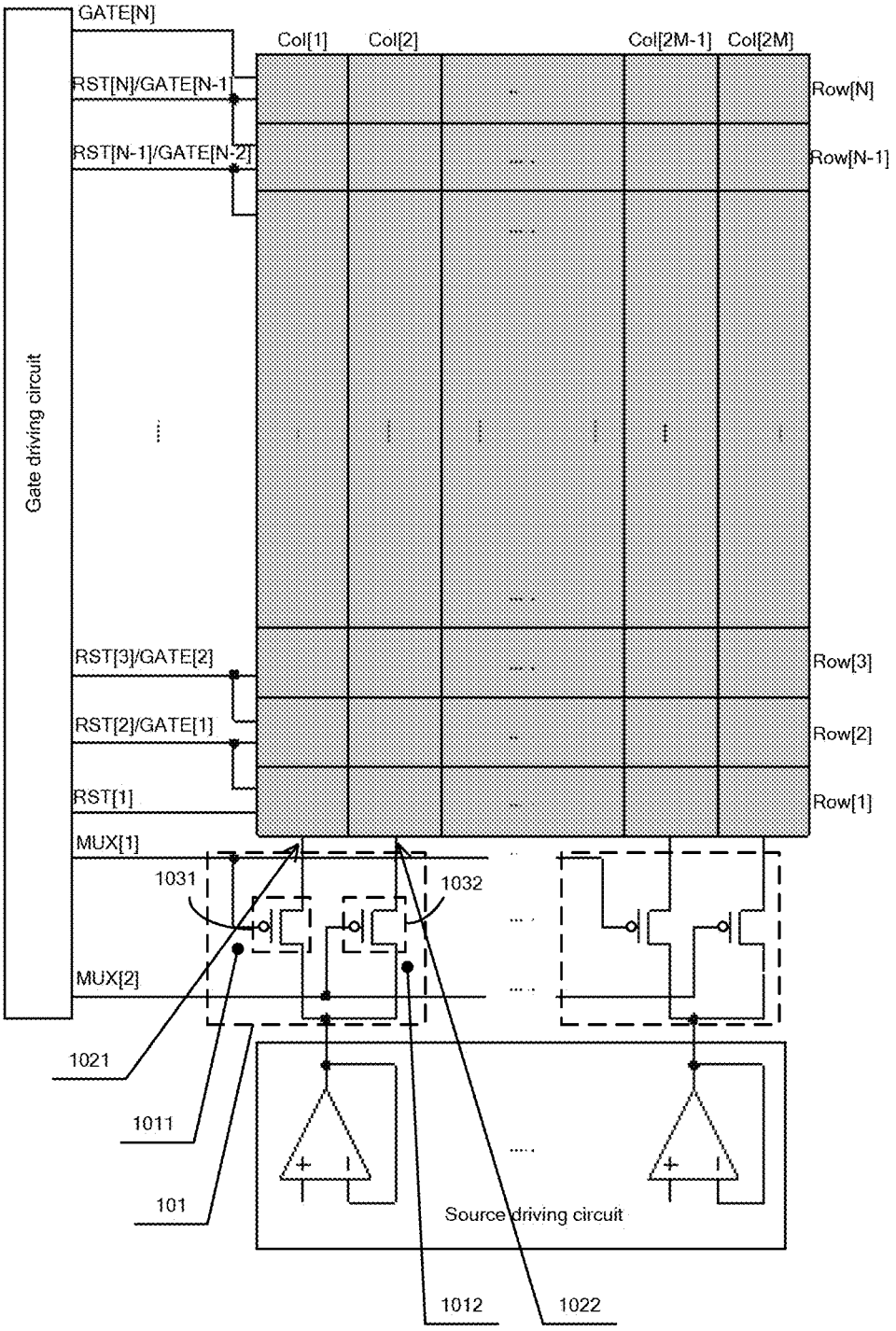
FIG. 1 is a schematic diagram of a display panel implementing a pixel driving method according to an embodiment of the present disclosure.

A pixel driving method according to an embodiment of the present disclosure is applied to a display panel. As shown in FIG. 1, an AMOLED display panel according to an embodiment of the present disclosure comprises a gate driving circuit, a source driving circuit, pixels in N rows and 2M columns, N gate lines respectively coupled to the N rows of pixels, 2M data lines respectively coupled to the 2M columns of pixels, and M multiplexers 101, wherein N and M are both natural numbers. The N rows of pixels are represented as Row[1], Row[2], Row[3] . . . Row[N−1], and Row[N] sequentially, and the 2M columns of pixels are represented as Col[1], Col[2] . . . Col[2M−1], and Col[2M] sequentially. Each of the multiplexers 101 is coupled to two data lines of the 2M data lines, and each multiplexer 101 has two driving branches each of which is used to drive a column of pixels. The two driving branches are denoted as a first driving branch 1011 and a second driving branch 1012 respectively. The first driving branch 1011 is coupled to a first data line 1021 of the two data lines, and the second driving branch 1012 is coupled to a second data line 1022 of the two data lines. The first driving branch 1011 is provided with a first switching element 1031, and the second driving branch 1012 is provided with a second switching element 1032.

Signals output by the gate driving circuit are represented as MUX1, MUX2, RST[1], RST[2]/GATE[1], RST[3]/GATE[2] RST[N−2]/GATE[N−3], RST[N]/GATE[N−1], and GATE[N] sequentially, wherein MUX1 is a first switching signal used to control the first switching element, MUX2 is a second switching signal used to control the second switching element, RST[1] is a reset control signal used to reset a first row of pixels, RST[N]/GATE[N−1] is a gate driving signal used to control turn-on and turn-off of an $(N-1)^{th}$ row of pixels, and is also a reset control signal used to reset an $N^{th}$ row of pixels.

The first switching element 1031 and the second switching element 1032 used in the embodiment of the present disclosure may be thin film transistors or field effect transistors. For example, they may be p-type transistors or n-type transistors. The following embodiments will be described by taking the p-type transistors as an example. The main difference between the p-type transistors and the n-type transistors is that the p-type transistors are turned on at a low level and the n-type transistors are turned on at a high level. In order to distinguish two electrodes of a thin film transistor except for a gate, one of the two electrodes is called a first electrode and the other of the two electrodes is called a second electrode. In actual use, the first electrode may be a drain and the second electrode may be a source, or the first electrode may be a source and the second electrode may be a drain.

The following embodiments will be described by taking a 7T1C pixel circuit as an example, but it may be understood by those skilled in the art that the pixels in the embodiments of the present disclosure may use, but not limited to, a 3T1C pixel circuit, a 4T1C pixel circuit, a 5T1C pixel circuit, a 6T1C pixel circuit, a 7T1C pixel circuit, etc., wherein T represents a thin film transistor, and C represents an energy storage capacitor (also referred as a pixel capacitor).

Figure 2:
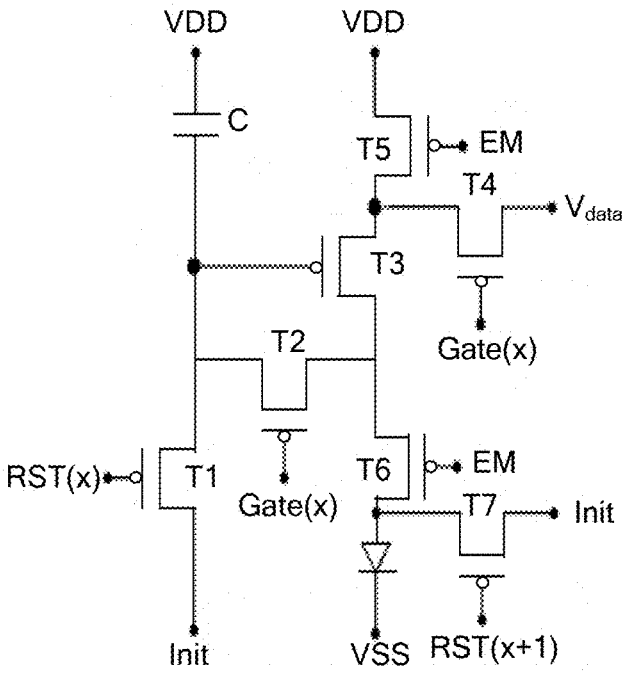
FIG. 2 is a diagram of a pixel circuit implementing a pixel driving method according to an embodiment of the present disclosure.

FIG. 2 is a diagram of a pixel circuit implementing a pixel driving method according to an embodiment of the present disclosure. The 7T1C pixel circuit is used to drive an $x^{th}$ row of pixels, wherein x is a natural number less than or equal to N. As shown in FIG. 2, the 7T1C pixel circuit comprises a second transistor T2 having a gate coupled to a gate driving signal output terminal Gate(x) of the gate driving circuit which is used to turn on the $x^{th}$ row of pixels. A first electrode of the second transistor T2 is coupled to one pole of an energy storage capacitor C, and the other pole of the energy storage capacitor C is coupled to a power supply voltage VDD. The first electrode of T2 is also coupled to a first electrode of a first transistor T1, a second electrode of the first transistor T1 is coupled to a reset signal Init, and a gate of the first transistor T1 is coupled to a reset control signal output terminal RST(x) of the gate driving circuit which is used to control the $x^{th}$ row of pixels. A second electrode of T2 is coupled to a second electrode of a third transistor (a driving transistor) T3, a gate of the third transistor T3 is coupled to the first electrode of T2, and a first electrode of the third transistor T3 is coupled to a first electrode of a fourth transistor T4. A second electrode of the fourth transistor T4 is coupled to an output terminal for a data signal $V_{data}$ of the source driving circuit, and a gate of the fourth transistor T4 is coupled to the gate driving signal output terminal Gate(x) of the gate driving circuit which is used to turn on the $x^{th}$ row of pixels. The first electrode of the third transistor T3 is coupled to a second electrode of a fifth transistor T5, a first electrode of the fifth transistor T5 is coupled to the power supply voltage VDD, and a gate of the fifth transistor T5 is coupled to a light emitting control signal EM. The second electrode of the second transistor T2 is also coupled to a first electrode of a sixth transistor T6, a second electrode of the sixth transistor T6 is coupled to an anode of a light emitting diode, and a cathode of the light emitting diode is coupled to a power supply voltage VSS. A gate of the sixth transistor T6 is coupled to the light emitting control signal EM, the second electrode of the sixth transistor T6 is also coupled to a first electrode of a seventh transistor T7, a second electrode of the seventh transistor T7 is coupled to the reset signal Init, and a gate of the seventh transistor T7 is coupled to a reset control signal output terminal RST(x+1) of the gate driving circuit which is used to control an $(X+1)^{th}$ row of pixels.

Figure 3:
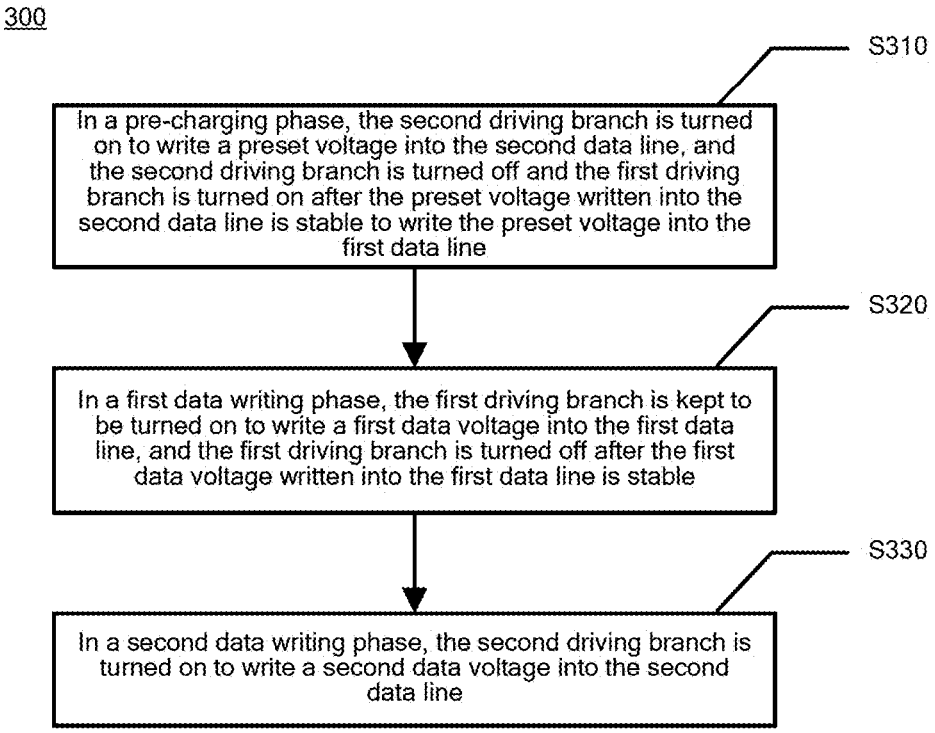
FIG. 3 is a flowchart of a pixel driving method according to an embodiment of the present disclosure.

FIG. 3 is a flowchart of a pixel driving method 300 according to an embodiment of the present disclosure. As shown in FIG. 3, the pixel driving method 300 comprises the following steps for each multiplexer.

In step S310, in a pre-charging phase, the second driving branch is turned on to write a preset voltage into the second data line, and the second driving branch is turned off and the first driving branch is turned on after the preset voltage written into the second data line is stable to write the preset voltage into the first data line.

In step S320, in a first data writing phase, the first driving branch is kept to be turned on to write a first data voltage into the first data line, and the first driving branch is turned off after the first data voltage written into the first data line is stable.

In step S330, in a second data writing phase, the second driving branch is turned on to write a second data voltage into the second data line.

According to an embodiment, one data writing cycle comprises a pre-charging phase, a first data writing phase, and a second data writing phase which are sequentially arranged.

Generally, when two columns of pixels are driven using the same multiplexer, during a pre-charging phase of one data writing cycle, each of the driving branches needs to be controlled to be turned on once to write a preset voltage into a data line for pixels, and then in a first data writing phase of the data writing cycle, one of the driving branches is controlled to be turned on to write a first data voltage into a part of a current row of pixels, and in a second data writing phase of the data writing cycle, the other one of the driving branches is turned on to write a second data voltage into the other part of the current row of pixels. That is, during one data writing cycle, each of the driving branches needs to be turned on and turned off twice, which results in a large alternating current load.

According to above solution of the embodiment of the present disclosure, during one data writing cycle, the first driving branch and the second driving branch are turned on and turned off only once, that is, the first switching element and the second switching element are turned on and turned off only once, so that switching frequencies of the first switching element and the second switching element are reduced, thereby reducing the alternating current load and reducing power consumption.

Further, according to an embodiment, during the same data writing cycle, the preset voltage is lower or higher than the first data voltage and the second data voltage.

It is determined whether the preset voltage is lower than or higher than the first data voltage and the second data voltage according to a type of the pixel circuit (a normal white pixel circuit or a normal black pixel circuit). For example, if the pixel circuit is a normal white pixel circuit, it may be determined that the preset voltage is higher than the first data voltage and the second data voltage; and if the pixel circuit is a normal black pixel circuit, it may be determined that the preset voltage is lower than the first data voltage and the second data voltage.

Further, according to an embodiment, the pixel driving method 300 further comprises the following operations.

In the first data writing phase, at least one row of pixels among the N rows of pixels is turned on after the first data voltage written into the first data line is stable, so that the first data voltage at the first data line is written into pixels coupled to the first data line among the at least one row of pixels, and the preset voltage at the second data line is written into pixels coupled to the second data line among the at least one row of pixels.

In the second data writing phase, the at least one row of pixels is kept to be turned on, and the first data voltage at the first data line is kept to be unchanged, so that the second data voltage at the second data line is written into the pixels coupled to the second data line among the at least one row of pixels, and the at least one row of pixels is turned off after the second data voltage written into the pixels coupled to the second data line among the at least one row of pixels is stable. Also, in the second data writing phase, the second driving branch is kept to be turned on after the second data voltage written into the pixels coupled to the second data line among the at least one row of pixels is stable, until a pre-charging phase for at least another row of pixels among the N rows of pixels arrives.

Further, before one data writing cycle, a reset voltage is written into the energy storage capacitor for the current row of pixels to reset the energy storage capacitor. After the reset voltage is written, residual charges in the energy storage capacitor for the current row of pixels are removed, that is, the residual charges in a previous frame of image in the energy storage capacitor are removed, so as to charge a voltage of a next frame of image into the energy storage capacitor.

Figure 4:
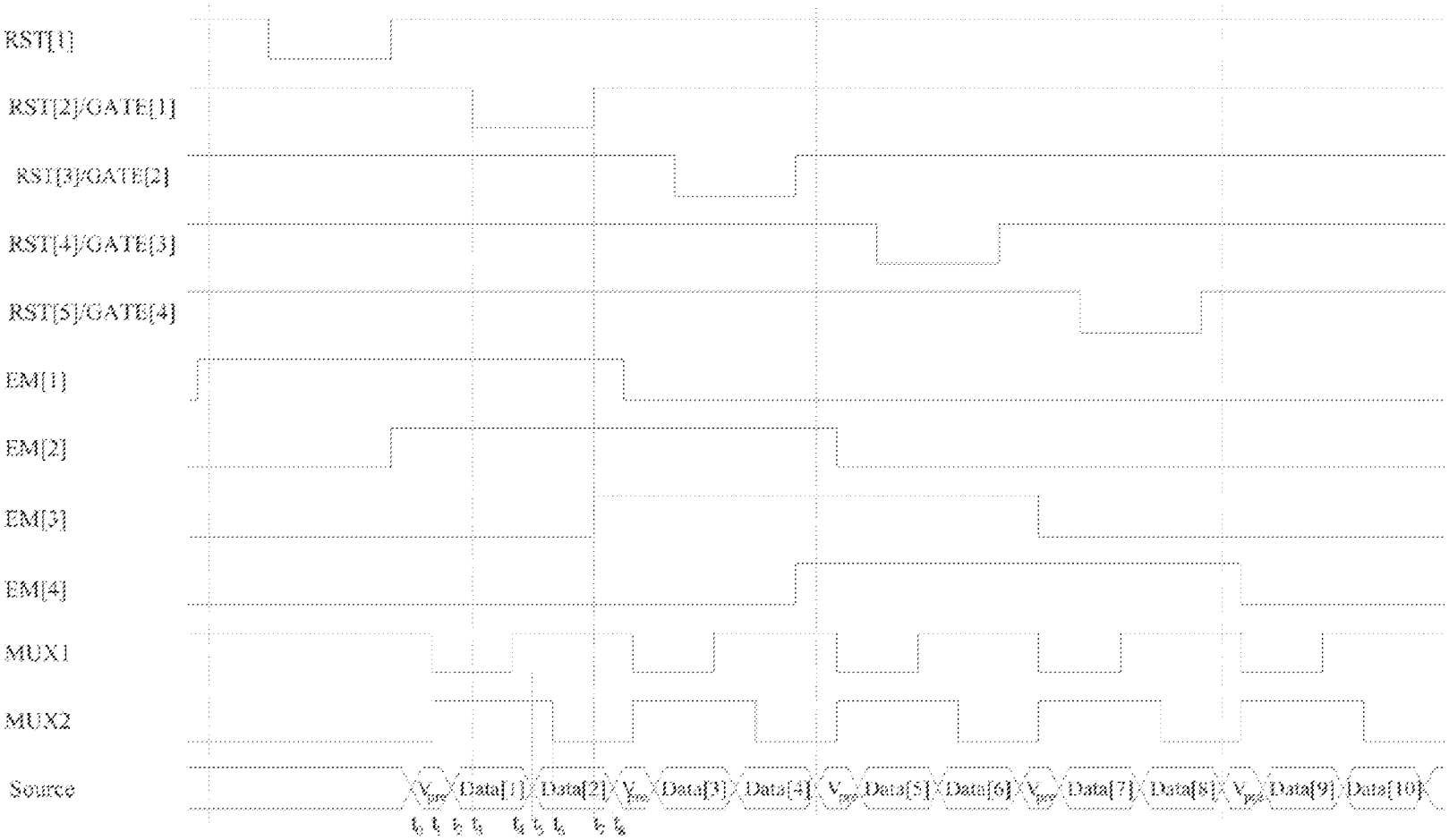
FIG. 4 is a timing diagram of a pixel driving method according to an embodiment of the present disclosure.

FIG. 4 is a timing diagram of a pixel driving method according to an embodiment of the present disclosure. FIG. 4 only shows pixels in four rows and ten columns for illustration. Gate driving signals for the four rows of pixels are represented as GATE[1], GATE[2], GATE[3], and GATE [4] sequentially, and data signals for the ten columns of pixels are represented as Data[1], Data[2] . . . Data[9], and Data[10] sequentially. An execution process of the pixel driving method 300 according to the embodiment of the present disclosure will be described in detail below with reference to FIGS. 2 to 4.

As shown in FIG. 4, a time period from time to $t_0$ time $t_2$ is a pre-charging phase, a time period from time $t_2$ to time $t_5$ is a first data writing phase, and a time period from time $t_5$ to time $t_8$ is a second data writing phase.

Before one data writing cycle, that is, before time to, an output terminal RST[1] of the gate driving circuit outputs a low level, a first transistor T1 for a first row of pixels which is controlled by RST[1] is turned on, and a reset voltage $V_{Init}$ is written into a pixel circuit for the first row of pixels, and after the reset voltage $V_{Init}$ is written completely, RST[1] outputs a high level, and the first transistor T1 is turned off.

At time to, an output terminal MUX2 of the gate driving circuit outputs a low level (a second level), a second switching element controlled by MUX2 is turned on, a second driving branch of a multiplexer is turned on, a source driving circuit writes a preset voltage $V_{pre}$ into the second driving branch which is turned on, and the second driving branch writes the preset voltage into a second data line. The preset voltage $V_{pre}$ written into the second data line reaches stable until the time $t_1$, output signals at the output terminals MUX1 and MUX2 of the gate driving circuit are reversed, that is, MUX1 outputs a low level (a second level), and MUX2 outputs a high level (a first level), and the second driving branch is turned off at this time, and the second data line coupled thereto is in a floating state. The second data line stores the written preset voltage $V_{pre}$ using its own parasitic capacitor. The first driving branch is turned on under control of the low level (a first level) output by MUX1, the source driving circuit writes the preset voltage $V_{pre}$ into the first driving branch which is turned on, and the first driving branch writes the preset voltage into a first data line. According to an embodiment, the output signals at the output terminals MUX1 and MUX2 of the gate driving circuit may be reversed at the same time, or the output signal at MUX1 may be reversed earlier than the output signal at MUX2, or the output signal at MUX1 may be reversed later than the output signal at MUX2.

At time $t_2$, both of the first data line and the second data line have been charged to the preset voltage $V_{pre}$. MUX1 still outputs a low level (the second level) at this time, and then the first switching element is still in a turn-on state, that is, the first driving branch is still in a turn-on state. The source driving circuit writes a voltage of a data signal, that is, the grayscale voltage Data[1], into pixels coupled to the first data line in the first row of pixels. The grayscale voltage Data[1] (output by the source driving circuit) reaches stable until time $t_3$, the gate driving signal GATE[1] for the current row (the first row) outputs a low level, a second transistor T2 for the current row of pixels is turned on, and the first data line writes the grayscale voltage Data[1] into the current row of pixels. The second data line charges pixels coupled to the second data line using its own parasitic capacitor at this time. The writing of the data into the current row of pixels by the first data line ends until time $t_4$, MUX1 outputs a high level (a first level), the first switching element is turned off, and the first data line stops charging the current row of pixels.

The source driving circuit stops outputting the grayscale voltage Data[1] and starts to output a grayscale voltage Data[2] at time $t_5$.

At time $t_6$, the grayscale voltage Data[2] (output by the source driving circuit) is stable, MUX2 outputs a low level (a second level), the second switching element is turned on, and the second driving branch writes the grayscale voltage Data[2] into pixels coupled to the second data line in the current row of pixels. A data voltage written into pixels coupled to the second data line reaches stable (reaches the grayscale voltage Data[2]) until time $t_7$, the gate driving signal GATE[1] for the current row outputs a high level, the second transistor T2 for the current row is turned off, and the writing of the data into the current row of pixels by the second data line ends. One data writing cycle ends at time $t_8$, that is, the writing of the data into the first row of pixels ends, and a next data writing cycle starts at time $t_8$ to write data signals into a second row of pixels. After the data signals for the current row are completely written, the light-emitting control signal EM[1] for the current row outputs a low level, and the current row of pixels emit light, and so on, the light-emitting control signal EM[4] for a fourth row outputs a low level, and a fourth row of pixels emit light.

Figure 5:
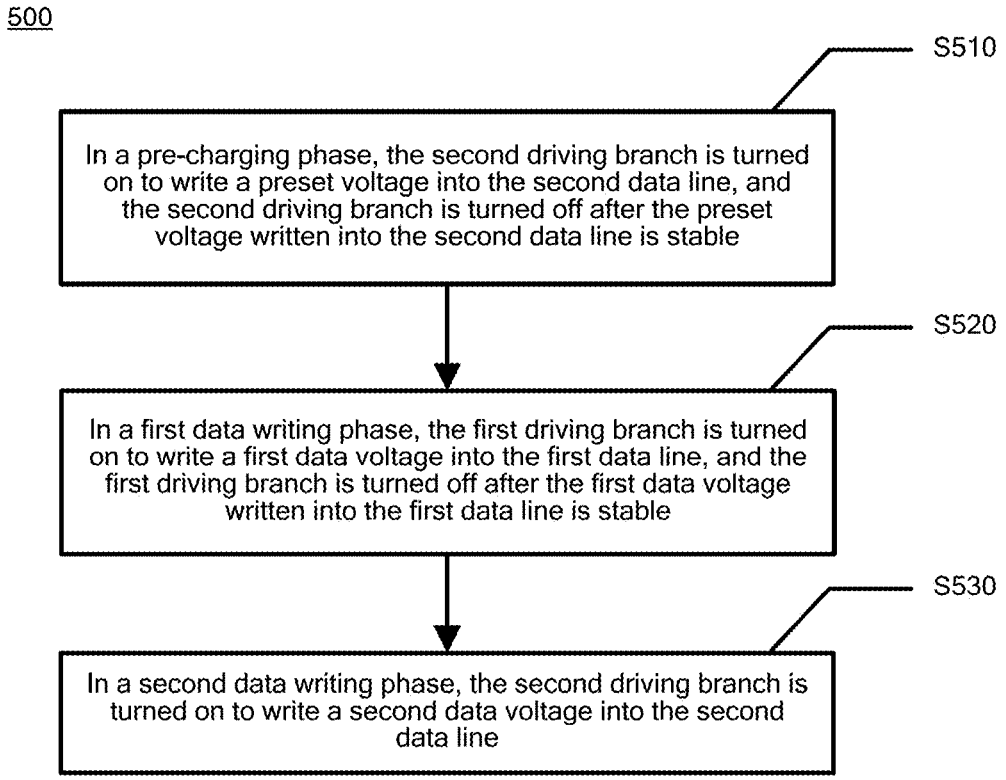
FIG. 5 is a flowchart of a pixel driving method according to another embodiment of the present disclosure.

FIG. 5 is a flowchart of a pixel driving method 500 according to another embodiment of the present disclosure. As shown in FIG. 5, the pixel driving method 500 comprises the following steps for each multiplexer.

In step S510, in a pre-charging phase, the second driving branch is turned on to write a preset voltage into the second data line, and the second driving branch is turned off after the preset voltage written into the second data line is stable.

In step S520, in a first data writing phase, the first driving branch is turned on to write a first data voltage into the first data line, and the first driving branch is turned off after the first data voltage written into the first data line is stable.

In step S530, in a second data writing phase, the second driving branch is turned on to write a second data voltage into the second data line.

Figure 6:
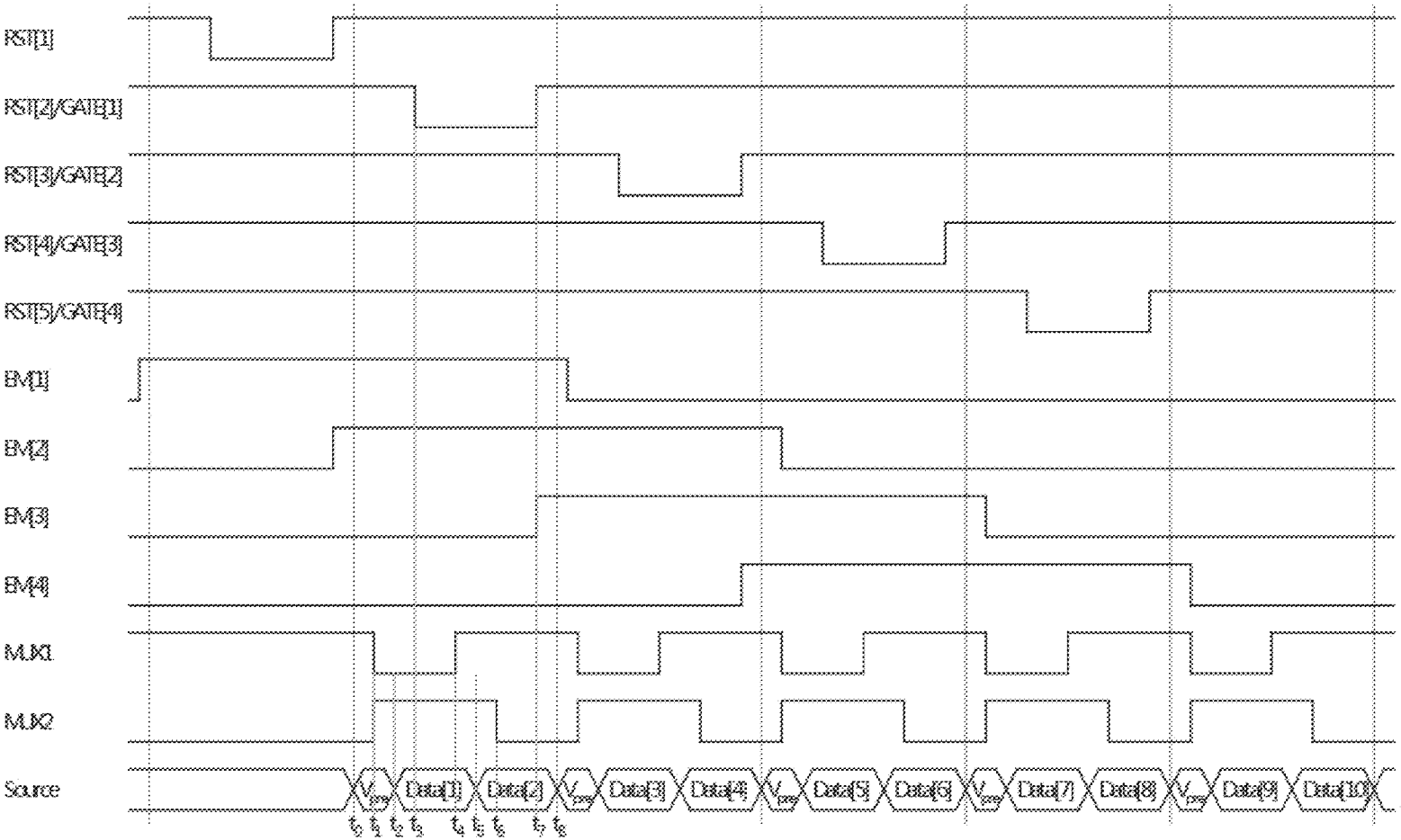
FIG. 6 is a timing diagram of a pixel driving method according to another embodiment of the present disclosure.

FIG. 6 is a timing diagram of a pixel driving method according to another embodiment of the present disclosure. As shown in FIG. 6, the main difference between this embodiment and the embodiment foregoing is that, in the pre-charging phase, the preset voltage is written only into the second data line, and the first driving branch is always in a turn-off state. In the first data writing phase, the first driving branch is turned on to write a first data voltage into the first data line coupled to the first driving branch, and the first switching element is turned off after the first data voltage written into the first data line is stable.

As shown in FIG. 6, MUX1 always outputs a high level (a first level) during the pre-charging phase. Then, in the first data writing phase, during time period from $t_2$ to $t_3$, MUX1 outputs a low level (a second level) until the grayscale voltage Data[1] is written into the first data line, and the first data voltage (the grayscale voltage Data[1]) written into the first data line reaches stable, that is, until the grayscale voltage Data[1] is completely written.

According to the embodiment of the present disclosure, during one data writing cycle, the first switching element and the second switching element are turned on and turned off only once, so that switching frequencies of the first switching element and the second switching element are reduced, thereby reducing the alternating current load and reducing power consumption.

The above description is only an explanation of preferred embodiments of the present application and the applied technical principles. It should be understood by those skilled in the art that the scope of the present disclosure involved in this application is not limited to the technical solutions formed by a specific combination of the above technical features, and should also cover other technical solutions formed by any combination of the above technical features or their equivalent features, for example, technical solutions formed by replacing the above features with (but not limited to) technical features disclosed in this application with similar functions, without departing from the inventive concept.

I claim:

1. A pixel driving method applied to a display panel comprising pixels in N rows and 2M columns and 2M data lines respectively coupled to the 2M columns of pixels, the display panel further comprising M multiplexers each of which is coupled to two data lines of the 2M data lines and has a first driving branch coupled to a first one of the two data lines and a second driving branch coupled to a second one of the two data lines, the pixel driving method comprising: for each of the multiplexers, in a pre-charging phase, turning on the second driving branch to write a preset voltage into the second data line, and turning off the second driving branch and turning on the first driving branch after the preset voltage written into the second data line is stable to write the preset voltage into the first data line;

in a first data writing phase, keeping the first driving branch to be turned on to write a first data voltage into the first data line, and turning off the first driving branch after the first data voltage written into the first data line is stable; and in a second data writing phase, turning on the second driving branch to write a second data voltage into the second data line.

2. The pixel driving method according to claim 1, further comprising:

in the first data writing phase, turning on at least one row of pixels among the N rows of pixels after the first data voltage written into the first data line is stable, so that the first data voltage at the first data line is written into pixels coupled to the first data line among the at least one row of pixels, and the preset voltage at the second data line is written into pixels coupled to the second data line among the at least one row of pixels; and in the second data writing phase, keeping the at least one row of pixels to be turned on, keeping the first data voltage at the first data line to be unchanged, so that the second data voltage at the second data line is written into the pixels coupled to the second data line among the at least one row of pixels, and turning off the at least one row of pixels after the second data voltage written into the pixels coupled to the second data line among the at least one row of pixels is stable.

3. The pixel driving method according to claim 2, further comprising:

in the second data writing phase, keeping the second driving branch to be turned on after the second data voltage written into the pixels coupled to the second data line among the at least one row of pixels is stable, until a pre-charging phase for at least another row of pixels among the N rows of pixels arrives.

4. The pixel driving method according to claim 1, wherein the preset voltage is lower or higher than the first data voltage and the second data voltage.

5. The pixel driving method according to claim 1, wherein the first driving branch comprises a first switching element, the second driving branch comprises a second switching element, the first switching element is turned on or turned off according to a first switching signal, and the second switching element is turned on or turned off according to a second switching signal, wherein in the pre-charging phase, providing the first switching signal at a first level and the second switching signal at a second level, so that the first switching element is turned off and the second switching element is turned on, so as to write the preset voltage into the second data line, and providing the first switching signal at the second level and the second switching signal at the first level after the preset voltage written into the second data line is stable, so that the first switching element is turned on and the second switching element is turned off, so as to write the preset voltage into the first data line;

in the first data writing phase, providing the first switching signal at the second level and the second switching signal at the first level, and keeping the first switching element to be turned on and the second switching element to be turned off, so as to write the first data voltage into the first data line, and providing the first switching signal at the first level after the first data voltage written into the first data line is stable, so that the first switching element is turned off; and in the second data writing phase, providing the second switching signal at the second level, so that the second switching element is turned on, so as to write the second data voltage into the second data line.

6. The pixel driving method according to claim 5, wherein the first switching element and the second switching element are thin film transistors.

7. A pixel driving method applied to a display panel comprising pixels in N rows and 2M columns and 2M data lines respectively coupled to the 2M columns of pixels, the display panel further comprising M multiplexers each of which is coupled to two data lines of the 2M data lines and has a first driving branch coupled to a first one of the two data lines and a second driving branch coupled to a second one of the two data lines, the pixel driving method comprising: for each of the multiplexers, in a pre-charging phase, turning on the second driving branch to write a preset voltage into the second data line, and turning off the second driving branch after the preset voltage written into the second data line is stable;

in a first data writing phase, turning on the first driving branch to write a first data voltage into the first data line, and turning off the first driving branch after the first data voltage written into the first data line is stable; and in a second data writing phase, turning on the second driving branch to write a second data voltage into the second data line.

8. The pixel driving method according to claim 7, further comprising:

in the first data writing phase, turning on at least one row of pixels among the N rows of pixels after the first data voltage written into the first data line is stable, so that the first data voltage at the first data line is written into pixels coupled to the first data line among the at least one row of pixels, and the preset voltage at the second data line is written into pixels coupled to the second data line among the at least one row of pixels; and in the second data writing phase, keeping the at least one row of pixels to be turned on, and keeping the first data voltage at the first data line to be unchanged, so that the second data voltage at the second data line is written into the pixels coupled to the second data line among the at least one row of pixels, and turning off the at least one row of pixels after the second data voltage written into the pixels coupled to the second data line among the at least one row of pixels is stable.

9. The pixel driving method according to claim 8, further comprising:

in the second data writing phase, keeping the second driving branch to be turned on after the second data voltage written into the pixels coupled to the second data line among the at least one row of pixels is stable, until a pre-charging phase for at least another row of pixels among the N rows of pixels arrives.

10. The pixel driving method according to claim 7, wherein the preset voltage is lower or higher than the first data voltage and the second data voltage.

11. The pixel driving method according to claim 7, wherein the first driving branch comprises a first switching element, the second driving branch comprises a second switching element, the first switching element is turned on or turned off according to a first switching signal, and the second switching element is turned on or turned off according to a second switching signal, wherein in the pre-charging phase, providing the first switching signal at a first level and the second switching signal at a second level, so that the first switching element is turned off and the second switching element is turned on, so as to write the preset voltage into the second data line, and providing the second switching signal at the first level after the preset voltage written into the second data line is stable, so that the second switching element is turned off;

in the first data writing phase, providing the first switching signal at the second level, so that the first switching element is turned on, so as to write the first data voltage into the first data line, and providing the first switching signal at the first level after the first data voltage written into the first data line is stable, so that the first switching element is turned off; and in the second data writing phase, providing the second switching signal at the second level, so that the second switching element is turned on, so as to write the second data voltage into the second data line.

12. The pixel driving method according to claim 11, wherein the first switching element and the second switching element are thin film transistors.

* * * * *